United States Patent [19]

Wada et al.

[11] 4,434,588

[45] Mar. 6, 1984

[54] HONING HEAD FOR HIGH-SPEED OPERATION

[75] Inventors: Minoru Wada; Isao Arai; Takeshi Okubo, all of Saitama; Yoshiaki Mori, Tokyo, all of Japan

[73] Assignee: Honda Giken Kogyo Kabushiki Kaisha, Tokyo, Japan

[21] Appl. No.: 299,207

[22] Filed: Sep. 3, 1981

[30] Foreign Application Priority Data

Sep. 10, 1980 [JP] Japan ..... 55-125521

[51] Int. Cl.[3] ..... B24B 33/08; B24B 33/02

[52] U.S. Cl. ..... 51/344; 51/181 R; 51/346

[58] Field of Search ..... 51/181 R, 204, 345, 51/344, 343, 346, 340, 339, 338, 350, 331; 408/22, 25, 27; 29/90 R, 566.1, 566

[56] References Cited

U.S. PATENT DOCUMENTS

| | | | |
|---|---|---|---|
| 1,601,813 | 10/1926 | Emerson . | |
| 1,955,362 | 4/1934 | Floss | 51/340 |
| 2,083,400 | 6/1937 | Rose et al. | 51/346 |
| 2,439,317 | 4/1948 | Peterson | 51/346 |
| 2,532,682 | 12/1950 | Sunnen . | |
| 2,537,286 | 1/1951 | Stovall . | |
| 3,378,962 | 4/1968 | Sunnen . | |
| 3,405,049 | 10/1968 | Czubak | 51/331 |
| 3,496,678 | 2/1970 | Engle | 51/344 |
| 3,727,352 | 4/1973 | Palazzi | 51/338 |
| 3,987,591 | 10/1976 | Czubak | 51/338 |
| 3,995,400 | 12/1976 | Gillette | 51/338 |
| 4,075,794 | 2/1978 | Blaylock | 51/343 |

FOREIGN PATENT DOCUMENTS

| | | | |
|---|---|---|---|
| 557488 | of 1932 | Fed. Rep. of Germany | 51/346 |
| 549827 | 8/1933 | Fed. Rep. of Germany . | |
| 1271586 | 6/1968 | Fed. Rep. of Germany . | |
| 1929347 | 4/1971 | Fed. Rep. of Germany . | |
| 2062097 | 6/1972 | Fed. Rep. of Germany | 51/346 |
| 2337639 | 2/1974 | Fed. Rep. of Germany | 51/345 |
| 2450686 | 5/1976 | Fed. Rep. of Germany | 51/338 |
| 1207339 | of 1970 | United Kingdom | 51/346 |
| 804398 | 2/1981 | U.S.S.R. | 51/204 |

*Primary Examiner*—Frederick R. Schmidt
*Assistant Examiner*—Robert Rose
*Attorney, Agent, or Firm*—Irving M. Weiner; Pamela S. Burt; John L. Shortley

[57] ABSTRACT

A honing head comprises a holder having a plurality of radial guide slots angularly spaced from each other and an axial hole, a rough-finishing cone shaft and a finishing cone shaft or a single cone shaft axially slidably received in the hole, and a plurality of rough-finishing and finishing honing stone supports alternately disposed in the guide slots for radial movement therein. The honing stone supports have axially spaced legs having inclined cam surfaces held in abutment with tapered portions of the cone shafts. The honing stone supports are connected to the cone shafts by connectors having one ends fixed to the honing stone supports and second ends slidably received in grooves defined in the cone shafts or the supports and having portions inclined with respect to the axes of the cone shafts in the same direction and at the same angle as the inclination of the tapered portions. Thus, axial movement of the cone shafts causes the honing stone supports to be forcibly displaced radially into or out of the guide slots. The holder includes reinforcement members mounted in the guide slots which members serve to give the holder a required degree of mechanical strength and rigidity for stabilizing the honing stone supports during honing operation and preventing a boring tool attached to the holder from being vibrated during boring operation.

4 Claims, 9 Drawing Figures

HONING HEAD FOR HIGH-SPEED OPERATION

BACKGROUND OF THE INVENTION (1) Field of the Invention

The present invention relates to a honing head for honing the internal cylindrical surface of a bore in a workpiece, and more particularly to a honing head capable of honing a workpiece at high speeds for high-performance honing operation.

(2) Prior Art

The internal cylindrical surface of a hole in a workpiece can be honed by rotating and reciprocating a honing head in the hole to enable honing stones mounted on the head to finish the cylindrical surface to a high degree of accuracy. Conventional honing heads rotate at speeds lower than those at which boring and other machines operate. Known honing heads generally comprise a hollow holder serving as a head body and having a plurality of radial guide slots defined therethrough and spaced at equal intervals from each other in the circumferential direction, a cone shaft axially reciprocably disposed in the holder, and a plurality of honing stone supports radially movably received in the guide slots, respectively, each of the honing stone supports having at least one radially inward cam surface held against at least one radially outward tapered surface defined on the cone shaft and extending axially thereof. When the cone shaft moves axially forwardly or rearwardly, the honing stone supports expand radially outwardly as they are guided by the guide holes to hold honing stones mounted on the honing stone supports against the cylindrical wall to be finished. The honing head is adapted to float in the hole in the workpiece by a universal joint. The head is caused to rotate and at the same time reciprocable as the honing stones slide along the hole surface to effect a low-speed honing operation. To prevent the honing stone supports from being forced out due to centrifugal forces and to retract them radially inwardly after the honing operation is finished, a common angular resilient member such as a spring is mounted on radially outward surfaces of the honing stone supports to fasten the supports together.

To carry out such a honing process at higher speeds for high-performance honing operation, it would be preferable to dispense with the universal joint and provide a sleeve member rearwardly of the honing head to receive the latter therein for reciprocating movement. The honing head would be provided therearound with boring tools such as cutting tools so as to be able to effect both boring operation and subsequent honing operation. With such an arrangement, a single machine can be used for different kinds of machining operations, workpieces can be machined in a shorter period of time, and machining operations can be performed with improved efficiency.

For such a high-speed honing operation, however, it is not desirable to rely on the prior honing head constructed as described above, and there has thus developed a desideratum for a novel honing head which meets the requirements of high-speed honing processes. More specifically, the structure wherein the honing stone supports are fastened radially inwardly by the annular resilient member to protect against centrifugal forces acting on the supports or to retract the supports radially inwardly cannot be put to practical use. A desired honing head should be constructed such that it will keep honing stone supports in position reliably against centrifugal forces due to high-speed rotation, and the honing stone supports can forcibly be withdrawn into the head after the honing operation is completed. The body of such a honing head should have an increased degree of mechanical strength and rigidity because insufficient rigidity of the head body tends to render the honing stone supports unstable during honing operation. Especially where the honing head is provided with boring tools for performing boring operations, the boring tools are liable to be vibrated when subjected to increased stresses during the boring operation, resulting in less accuracy of bored surfaces.

SUMMARY OF THE INVENTION

The present invention provides a honing head capable of high-speed honing operation.

It is an object of the present invention to provide a honing head for high-speed operation comprising a hollow holder, a cone shaft axially slidably disposed in the hollow holder, and a plurality of honing stone supports radially movably inserted in radial guide slots in the holder and connected to the cone shaft by connectors. The honing stone supports can thus be held reliably in the holder without being forced out under centrifugal forces imposed when the honing head rotates at high speeds. The honing stone supports are held against tapered portions of the cone shaft which are inclined with respect to the axis of the cone shaft. The connectors have first ends connected to one of the cone shaft and the honing stone supports and the other end slidably received in grooves defined in the other of the cone shaft and the honing stone supports, the grooves being included in the same direction and at the same angle as the inclination of the tapered portions of the cone shafts. Axial sliding movement of the cone shaft in the holder causes the honing stone supports to be reliably forcibly displaced into and out of the holder through the connectors, thereby enabling high-performance honing operation at high speeds.

Another object of the present invention is to provide a honing head for high-speed operation with the connectors disposed in optimum positions. The tapered portions of the cone shaft are located at two axially spaced positions, and the honing stone supports have two axially spaced inner cam surfaces held in contact with the tapered portions of the cone shaft. The connectors are positioned axially between the tapered portions or the cam surfaces which are axially spaced from each other.

Still another object of the present invention is to provide a honing head having mechanical strength and rigidity necessary for high-speed operation. With each connector connected at a first end to the honing stone supports and received at the other end in the grooves in the cone shafts, the connectors are movable with the honing stone supports only in the radial direction, but not in the axial direction. Such an arrangement allows reinforcement members to be provided in the guide slots in which the honing stone supports are inserted. The reinforcement members provide a required degree of mechanical strength and rigidity to the holders with the radial guide slots defined therein. Even where the holder is equipped around its periphery with a boring tool for performing boring operations as well as honing operations, the reinforcement members render the honing stone supports stable in position and prevent the boring tool from being vibrated during boring operation.

Still another object of the present invention is to provide a honing head for high-speed operation which will perform rough-finishing honing operations and finishing honing operations. Rough-finishing and finishing honing stone supports are disposed in the guide slots in the holder. A pair of rough-finishing and finishing cone shafts or a single cone shaft is mounted in the holder for axial movement therein to expand the rough-finishing honing stone supports radially outwardly for the rough-finishing honing operation and the finishing honing stone supports radially outwardly for the finishing honing operation.

The present invention will now be described with reference to the drawings which illustrate preferred embodiments of the invention.

DETAILED DESCRIPTION OF THE PREFERRED EMBODIMENTS

Figure 1:
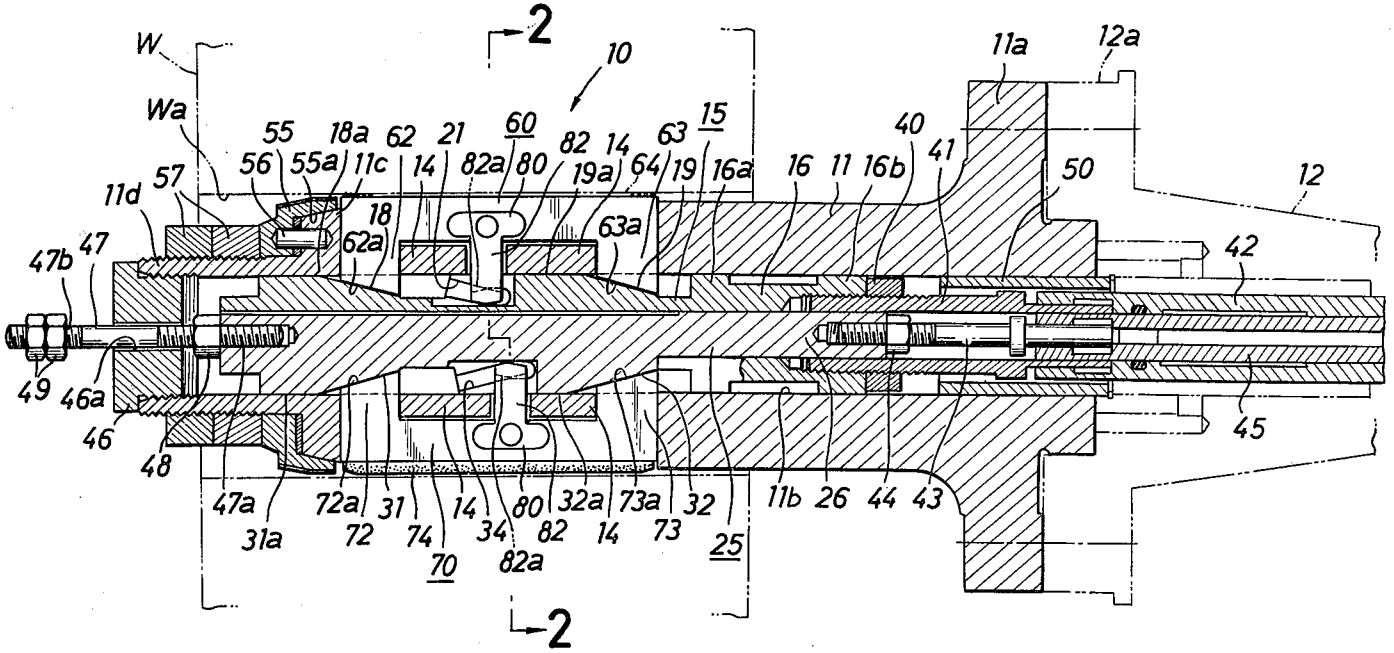
FIG. 1 is a longitudinal cross-sectional view of a honing head having rough-finishing and finishing cone shafts.
Figure 2:
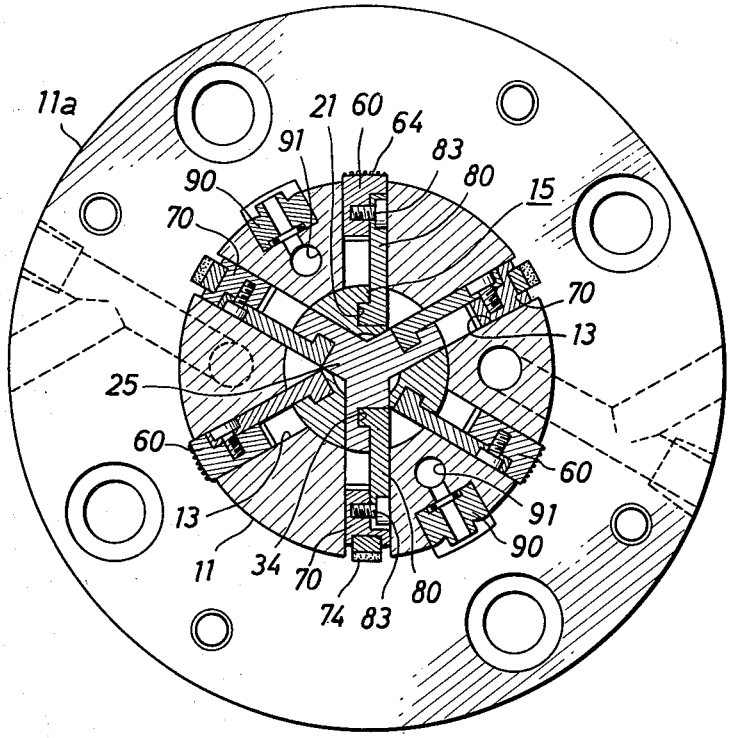
FIG. 2 is a cross-sectional view taken along line II—II of FIG. 1.

As shown in FIGS. 1 and 2, a honing head 10 includes a body or holder 11 having a rear flange 11*a* bolted to a front flange 12*a* of a spindle 12. The holder 11 is caused by the spindle 12 to rotate about its own axis. The spindle 12 is connected at a rear end thereof to a suitable reciprocatory mechanism (not shown) for reciprocating the holder 11 and the spindle 12 in their axial direction. The spindle 12 is axially reciprocably inserted in a bore in a sleeve (not shown). During honing operation, the spindle 12 is guided by the cylindrical surface of the bore in the sleeve to allow axial reciprocating movement of the holder 11 and the spindle 12. Contrary to conventional honing heads rendered floating by universal joints, the honing head 10 according to the present invention is rigidly supported for high-speed reciprocatory and rotational movement of the head 10 during honing operation.

Figure 3:
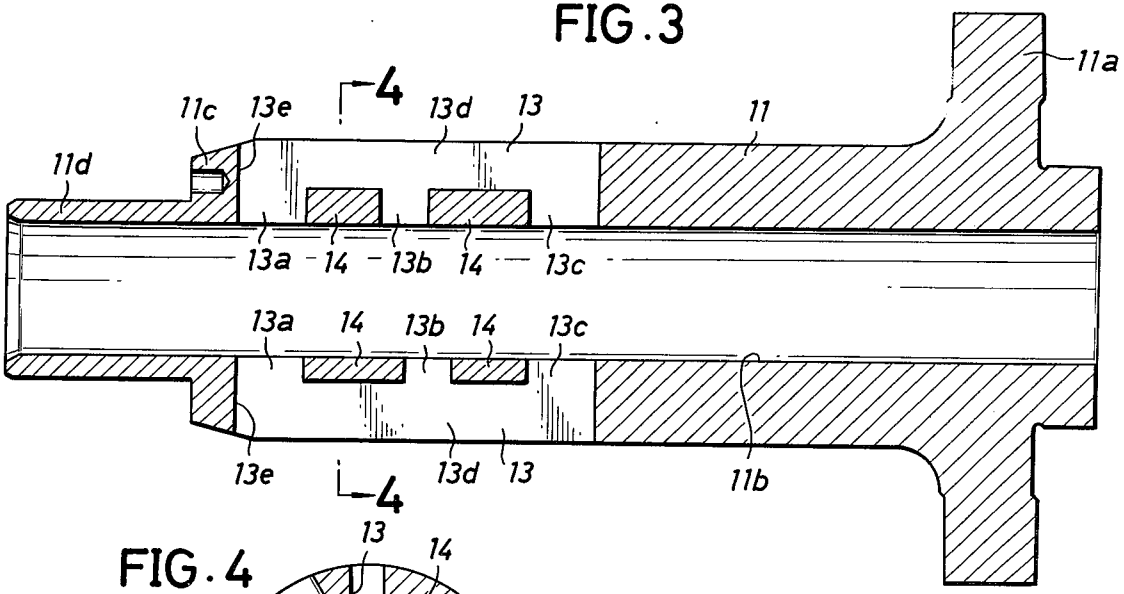
FIG. 3 is a longitudinal cross-sectional view of a holder serving as a head body.
Figure 4:
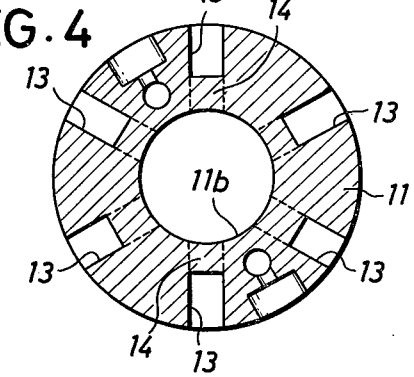
FIG. 4 is a cross-sectional view taken along line IV—IV of FIG. 3.

As illustrated in FIGS. 3 and 4, the holder 11 is of a hollow structure having a coaxial through hole or bore 11*b* and a plurality of guide slots 13 disposed slightly forwardly of the center in the longitudinal direction of the holder 11 and extending radially from the through hole 11*b* to the outer periphery of the holder 11. Each guide slot 13 has an elongated dimension in the axial direction of the holder 11 and has a constant width. As shown in FIG. 4, the guide slots 13 are angularly spaced at equal intervals from each other in the circumferential direction of the holder 11 and are provided in an even number, i.e., six in the illustrated embodiment. A pair of reinforcement members 14 are mounted in each of the guide slots 13 and spaced from each other axially of the holder 11. The reinforcement members 14 are formed by being left uncut when the guide slots 13 are cut in the holder 11. With two such reinforcement members 14, 14 in each guide slot 13, the guide slot 13 comprises three radial slot portions 13*a*, 13*b*, 13*c* spaced axially from each other and communicating with the hole 11*b* and the outer periphery of the holder 11, and an axial slot portion 13*d* connecting radially outward regions of the slot portions 13*a*, 13*b*, 13*c* and having a depth from the outer periphery of the holder 11.

The guide slots 13 are closed off at their front ends 13*e* by a tapered wall 11*c*. Thus, the guide slots 13 terminate short of a front end of the holder 11. With the tapered wall 11*c* and the reinforcement members 14, the holder 11 has an increased degree of mechanical strength and rigidity. A front end sleeve 11*d* is integral with the tapered wall 11*c* and extends forwardly therefrom.

Figure 5:
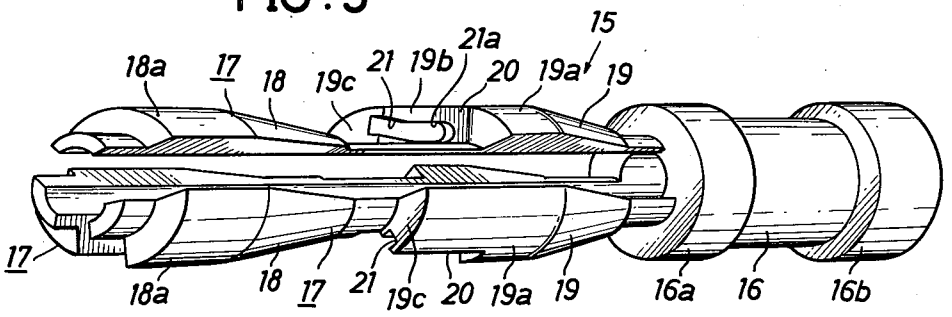
FIG. 5 is a perspective view of the rough-finishing cone shaft.

A rough-finishing cone shaft 15 illustrated in FIG. 5 comprises a rear cylindrical portion 16 and three split branch members 17 extending forwardly from the rear cylindrical portion 16 in parallel relation to each other. The split branch members 17 have a sectorial transverse cross section and are angularly spaced at equal intervals from each other in the circumferential direction of the cone shaft 15. Each of the split branch members 17 has two axially spaced tapered portions 18, 19 tapered at the same angle of inclination and diverging progressively toward the front end of the cone shaft 15. The tapered portions 18, 19 have front shoulders 18*a*, 19*a*, respectively, which are spaced from the axis of the cone shaft 15 by the same distance. The rough-finishing cone shaft 15 also includes large-diameter portions 16*a*, 16*b* located one on each side of the cylindrical portion 16 in the axial direction of the cone shaft 15. When the cone shaft 15 is placed in the hollow holder 11 as illustrated in FIG. 1, the shoulders 18*a*, 19*a* and the large-diameter portions 16*a*, 16*b* are slidably held against the cylindrical wall of the through hole 11*b* to allow axial slidable movement of the cone shaft 15 in the holder 11. Each of the shoulders 19*a*, which are located rearwardly of the shoulders 18*a*, is cut to define a side step or recess 20 extending in the circumferential direction of the cone shaft 15. The step 20 has a bottom or a side edge 19*b* of the shoulder 19*a* having therein a groove 21 which includes a portion inclined with respect to the axis of the cone shaft 15. The direction and angle of inclination of the inclined portion of the groove 21 are the same as those of the tapered portions 18, 19 for expanding or displacing rough-finishing honing stone supports (later described) radially outwardly. The groove 21 has a front end opening at a front face 19*c* of the shoulder 19*a* and a rear portion 21*a* extending parallel to the axis of the cone shaft 15.

Figure 6:
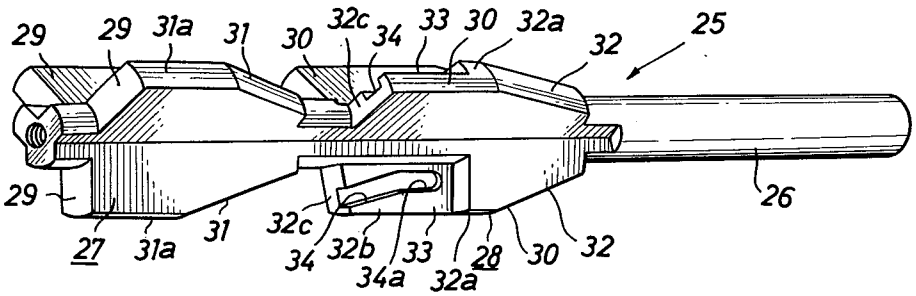
FIG. 6 is a perspective view of the finishing cone shaft.

A finishing cone shaft 25 shown in FIG. 6 comprises a rear rod portion 26 and a pair of trifurcate portions 27, 28 spaced axially from each other and located axially forwardly of the rod portion 26. The trifurcate portions 27, 28 have three projections 29, 30, respectively, extending radially outwardly of the axis of the finishing cone shaft 25 and angularly spaced at equal intervals from each other. All of the projections 29, 30 are in the form of a plate having an equal thickness. The projections 29, 30 include tapered portions 31, 32, respectively, tapered at the same angle of inclination and positioned axially rearwardly so that the tapered portions 31, 32 diverge progressively toward a front end of the cone shaft 25. The tapered portions 31, 32 include front shoulders 31*a*, 32*a*, respectively, which project radially outwardly of the axis of the cone shaft 25 by the same distance that by which the shoulders 18*a*, 19*a* of the rough-finishing cone shaft 15 project radially outwardly from the axis of the cone shaft 15. As the finishing cone shaft 25 is put in the holder 11, the shoulders 31*a*, 32*a* are slidable against the inner cylindrical wall of the bore 11*b* to permit the cone shaft 25 to move slidably axially in the holder 11. Each of the shoulders 32*a* which are disposed rearwardly of the shoulders 31*a* is cut to define a side step or recess 33 extending in the circumferential direction of the cone shaft 25 and having a bottom or side edge 32*b* of the shoulder 32*a* which has therein a groove 34. The groove 34 includes a portion inclined with respect to the axis of the cone shaft 25 in the same direction and at the same angle as the inclination of the tapered portions 31, 32 to enable finishing honing stone supports (later described) to be expanded or displaced radially outwardly. The groove 34 has a front end opening at a front face 32*c* of the shoulder 32*a* and a rear portion 34*a* extending parallel to the axis of the cone shaft 25.

The finishing cone shaft 25 and the rough-finishing cone shaft 15 are assembled together by inserting the rod portion 26 of the cone shaft 25 into the cylindrical portion 16 of the cone shaft 15 past the split branch members 17 with the projections 29, 30 fitted between the branch members 17. The assembled cone shafts 15, 25 are placed in the hole 11*b* in the holder 11 as illustrated in FIG. 1, the cone shafts 15, 25 being axially slidable in the holder 11 independently of each other. As shown in FIG. 1, a cylindrical shaft 41 has one end threaded in the cylindrical portion 16 of the rough-finishing cone shaft 15 and secured thereto by a nut 40. The cylindrical shaft 41 is coaxially coupled at the other end thereof to a distal end of an intermediate cylindrical shaft 42 which is connected to a suitable drive means such as a fluid-pressure actuator (not shown). When the drive means is actuated, the rough-finishing cone shaft 15 is slid axially back and forth in the hole 11*b* through the cylindrical shafts 41, 42. To the rear rod portion 26 of the finishing cone shaft 25 as inserted in the cylindrical portion 16 of the rough-finishing cone shaft 15, there is threadedly connected one end of a threaded rod 43 which is secured in position by a nut 44. The threaded rod 43 is coupled at the other end thereof to a distal end of an intermediate shaft 45 connected to a suitable drive means such as a fluid-pressure actuator. When the drive means is in operation, the finishing cone shaft 25 is slidably moved back and forth by means of the threaded rod 43 and the intermediate shaft 45.

The holder 11 has a front end opening in which there is threaded a threaded cap 46 having a hole 46*a* through which extends a stopper rod 47 having a rear threaded end portion 47*a* threaded in and fastened by a nut 48 to a distal end of the finishing cone shaft 25. The stopper rod 47 has a front threaded end portion 47*b* on which there are threaded a pair of nuts 49 which, when held against the cap 46, limit movement of the finishing cone shaft 25 on a retracting stroke thereof for displacing finishing honing stone supports radially outwardly. A collar 50 is fitted in the hole 11*b* in the holder 11 to limit movement of the rough-finishing cone shaft 15 on a retracting stroke thereof for displacing rough-finishing honing stone supports radially outwardly when the nut 40 is brought into abutting engagement with the collar 50.

A boring tool 55 is fitted over the front end sleeve 11*d* and has a tapered surface 55*a* which is held in complementary engagement with the tapered wall 11*c*. The boring tool 55 is located by a pin with respect to the holder 11 in the circumferential direction thereof. The boring tool 55 is fixed to the holder 11 by a pair of nuts 57 threaded on the front end sleeve lid and pressing the tool 55 against the tapered wall 11*c*. The boring tool 55 according to the illustrated embodiment is in the shape of a toothed wheel having projections and alternate recesses on the circumference, there being hard particles such as diamond particles embedded in the recesses. The boring tool 55 can thus rotate with the holder 11 to bore a workpiece.

Figure 7:
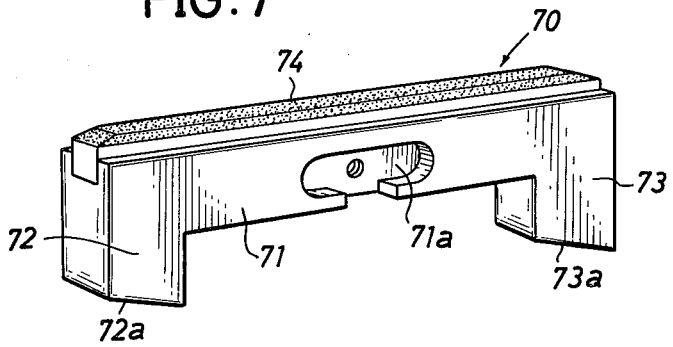
FIG. 7 is a perspective view of a honing stone support.

Rough-finishing and finishing honing stone supports 60, 70 are basically of the same construction, the finishing honing stone support 70 being shown in FIG. 7. The honing stone support 70 comprises an elongated base 71 and a pair of parallel legs 72, 73 extending from the ends of the base 71 in the same direction and spaced from each other by the interval at which the tapered portions 31, 32 of the finishing cone shaft 25 are spaced from each other. The legs 72, 73 have inner cam surfaces 72*a*, 73*a*, respectively, engageable with the tapered portions 31, 32 when the honing stone support 70 is assembled in the holder 11. The direction and angle of inclination of the cam surfaces 72*a*, 73*a* are the same as those of the tapered portions 31, 32. The support base 71 supports a finishing honing stone 74 on an outer surface thereof remote from the legs 72, 73. As illustrated in FIGS. 1 and 2, each of the rough-finishing honing stone supports 60 supports thereon a single-layer rough-finishing honing stone 64.

Figure 8:
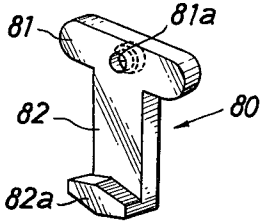
FIG. 8 is a perspective view of a connector.

FIG. 8 shows a connector 80 which connects each of the rough-finishing honing stone supports 60 to the rough-finishing cone shaft 15, and connects each of the finishing honing stone supports 70 to the finishing cone shaft 25. The connector 80 is substantially T-shaped comprising a base 81 and a transverse member 82 extending at a right angle from the base 81. The base 81 has a bolt-insertion aperture 81*a*, and the transverse member 82 has on its distal end a laterally projecting engagement ledge 82*a* substantially in the form of a lozenge. Such connectors 80 are attached to the honing stone supports 60, 70. By way of example, the base 81 of the connector 80 is fitted in a cavity 71*a* (FIG. 7) defined in a side of the base 71 of the honing stone support 70, and a bolt 83 (FIG. 2) is threaded through the aperture 81*a* into the base 71, thus fastening the connector 80 to the support 70. As thus assembled, the connector 80 is mounted on the support 70 at the base 81 with the transverse member 82 located between the legs 72, 73 of the support 70. The legs 72, 73 and the transverse member 82 extend in the same direction and cause the support 70 to resemble a tripodal structure.

Three such rough-finishing honing stone supports 60 with the connectors 80 attached and three such finishing honing stone supports 70 with the connectors 80 attached are respectively inserted alternately into the six radial guide slots 13 in the holder 11 as shown in FIG. 2. More specifically, front and rear legs 62, 63, 72, 73 of the honing stone supports 60, 70 are inserted in the front and rear radial slot portions 13*a*, 13*c* of the guide slots 13, and the transverse portions 82 of the connectors 80 are inserted in the central radial slot portions 13*b* of the guide slots 13. The legs 62, 63, 72, 73 and the transverse members 82 have their ends projecting into the hole 11*b* in the holder 11. The engagement ledges 82*a* on the transverse members 82 of the connectors 80 are received respectively in the grooves 21, 34 in the rough-finishing and finishing cone shafts 15, 25. The engagement ledges 82*a* can be inserted into the grooves 21, 34 by first retracting the cone shafts 15, 25 and then moving them forwardly as the grooves 21, 34 open at the front faces 19*c*, 32*c* of the shoulders 19*a*, 32*a* of the cone shafts 15, 25, respectively.

Thus, the distal or inner ends of the connectors 80 are slidably received in the grooves 21, 34 in the cone shafts 15, 25. The rough-finishing and finishing honing stone supports 60, 70 are thus connected respectively to the rough-finishing and finishing cone shafts 15, 25, respectively. Inner cam surfaces 62*a*, 63*a* on the legs 62, 63 of the rough-finishing honing stone supports 60 are held against the tapered portions 18, 19 of the rough-finishing cone shaft 15, and the inner cam surfaces 72*a*, 73*a* on the legs 72, 73 of the finishing honing stone supports 70 are held against the tapered portions 31, 32 of the finishing cone shaft 25. The connectors 80 are thus positioned between the tapered portions 18, 19, 31, 32 of the cone shafts 15, 25 and the cam surfaces 62*a*, 63*a*, 72*a*, 73*a* of the honing stone supports 60, 70.

As illustrated in FIG. 2, the holder 11 has air nozzles 90 on its outer periphery and air passages 91 therein for blowing air out of the air nozzles 90 to enable an air gage to measure the finished dimensions of a bore in a workpiece after the bore has been honed.

The honing head 10 according to the invention will finish a hole Wa in a workpiece W, such as a cylinder bore in a cylinder block of an internal combustion engine, as follows:

As the holder 11 is rotated by the spindle 12 and moved forwardly through the workpiece W, the boring tool 55 enlarges the bore Wa to a predetermined diameter with a single stroke of the holder 11, there being material left which is to be removed from the bore during the honing operation. With the reinforcement members 14 in the guide slots 13 which are located between the legs 62, 63, 72, 73 of the honing stone supports 60, 70 and the connectors 80 and serve to increase the mechanical strength and rigidity of the holder 11, the holder 11 which serves as both the honing head body and the boring head body prevents the boring tool 55 from being vibrated even when the holder 11 is subjected to undue stresses during the boring operation.

After the workpiece W has been bored, the holder 11 is pulled out of the hole Wa, and the rough-finishing cone shaft 15 is slidably retracted causing the tapered portions 18, 19 of the cone shaft 15 to displace the three rough-finishing honing stone supports 60 radially outwardly under camming action as they are guided in the corresponding guide slots 13. Then, the holder 11 while being rotated is inserted into the bored hole Wa in the workpiece W and is reciprocated axially in the hole Wa for rough honing of the internal cylindrical surface of the hole Wa with the rough-finishing honing stones 64 on the supports 60. After the hole Wa has been roughly honed, the rough-finishing cone shaft 15 is moved forwardly causing the grooves 21 to displace the ledges 82*a* received therein and hence the connectors 82 radially inwardly, whereupon the rough-finishing honing stone supports 60 are forcibly withdrawn into the holder 11 without fail.

Thereafter, the finishing cone shaft 25 is axially retracted to cause the tapered portions 31, 32 thereof to cam the finishing honing stones 70 radially outwardly. By then rotating and reciprocating the holder 11 in the hole Wa, the finishing honing stones 74 on the supports 70 hone the internal cylindrical surface of the hole Wa to a predetermined final dimension or surface finish. After the hole Wa has been finally honed, the finishing cone shaft 25 is moved forwardly thereby causing the finishing honing supports 70 to be forcibly moved radially inwardly by the connectors 80 with the legs 80*a* thereof guided in the grooves 34 in the finishing cone shaft 25.

With the honing head 10 thus constructed, the connectors 80 are movable only radially inwardly and outwardly in unison with the honing stone supports 60, 70, but not axially back and forth, while enabling the supports 60, 70 to be radially protruded or retracted when the cone shafts 15, 25 are moved forwardly or rearwardly. Accordingly, it is possible to leave the reinforcement members 14, 14 in each guide slot 13 which are located between the legs 62, 63, 72, 73 of the honing stone supports 60, 70 and the connectors 80.

Since the honing stone supports 60, 70 are firmly connected by the connectors 80 to the cone shafts 15, 25, the honing stone supports 60, 70 are reliably prevented from being thrown out of the holder 11 under centrifugal forces when the holder 11 is rotated at high speeds for high-performance honing operation.

Figure 9:
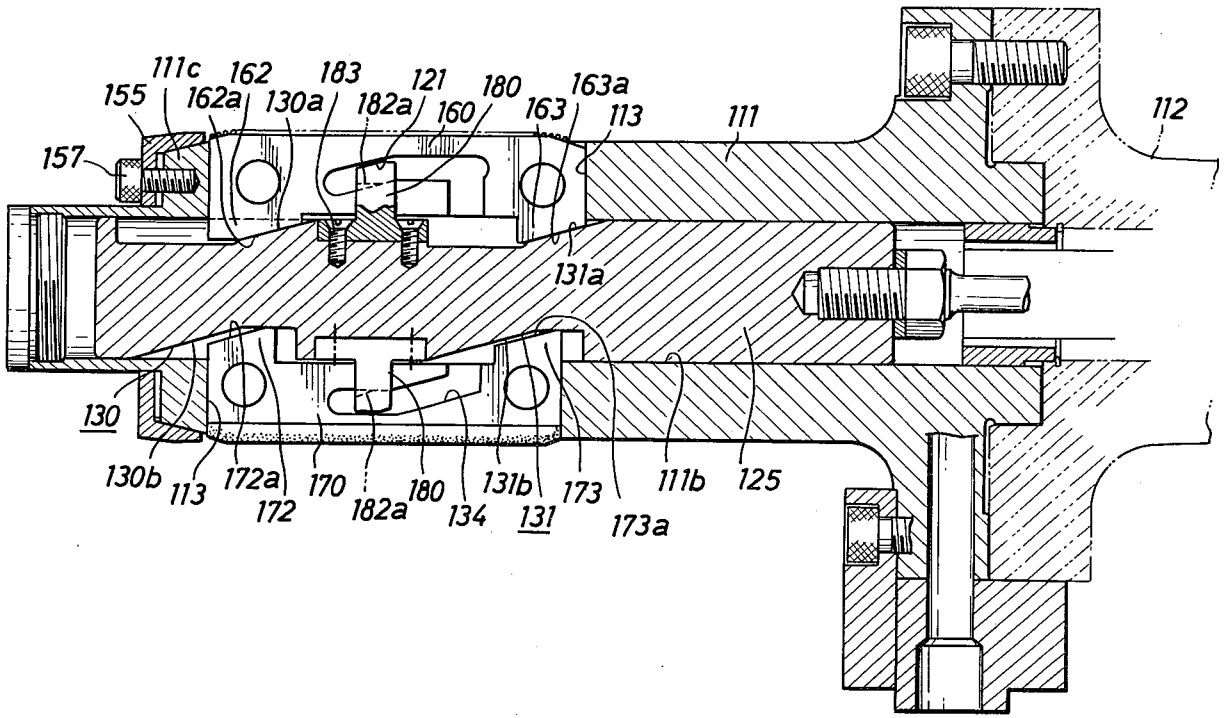
FIG. 9 is a longitudinal cross-sectional view of a honing head having one cone shaft.

FIG. 9 illustrates a honing head 110 according to another embodiment which has a single cone shaft and rough-finishing and finishing honing stone supports radially movable by axial movement of the single cone shaft.

The honing head 110 comprises a hollow holder 111 connected to a front end of a spindle 112 for being rotated thereby and having an axial hole 111*b* in which a cone shaft 125 is axially slidably inserted. The cone shaft 125 has a pair of axially spaced tapered portions 130, 131 which define a pair of rough-finishing tapered surfaces 130*a*, 131*a* and a pair of finishing tapered surfaces 130*b*, 131*b*. The rough-finishing tapered surfaces 130*a*, 131*a* are tapered in a direction opposite to that in which the finishing tapered surfaces 130*b*, 131*b* are tapered. In the illustrated embodiment, the rough-finishing tapered surfaces 130*a*, 131*a* diverge progressively rearwardly from the axis of the cone shaft 125, and the finishing tapered surfaces 130*b*, 131*b* diverge progressively forwardly from the axis of the cone shaft 125.

The holder 111 has a plurality of angularly spaced guide slots 113 in which there are respectively disposed a plurality of rough-finishing and finishing honing stone supports 160, 170 having front and rear legs 162, 163 and 172, 173, respectively, which have respective inner cam surfaces 162*a*, 163*a* and 172*a*, 173*a* held in contact with the tapered surfaces 130*a*, 131*a* and 130*b*, 131*b*, respectively, on the cone shaft 125. The honing stone supports 160, 170 are connected to the cone shaft 125 by connectors 180 having inner ends coupled to the cone shaft 125 by bolts 183. The connectors 180 have at outer ends thereof lateral ledges 182*a* slidably received in grooves 121, 134 defined in sides of the honing stone supports 160, 170. The grooves 121 include portions inclined in the same direction and at the same angle as the inclination of the tapered surfaces 130*a*, 131*a*. Likewise, the grooves 134 include portions inclined in the same direction and at the same angle as the inclination of the tapered surfaces 130*b*, 131*b*. A boring tool 155 is fixed by a bolt 157 to a tapered wall 111*c* of the holder 111.

The honing head 110 can thus effect boring operation as well as honing operation. For rough-finishing honing operation, the cone shaft 125 is moved axially forwardly to cause the rough-finishing honing stone supports 160 to be pushed out of the holder 111 radially outwardly and also to cause the finishing honing stone supports 170 to be withdrawn into the holder 111 radially inwardly. Conversely, when the cone shaft 125 is moved axially rearwardly for finishing honing operation, the rough-finishing honing stone supports 160 are retracted into the holder 111 radially inwardly, and the finishing honing stone supports 170 are displaced out of the holder 111 radially outwardly.

We claim:

1. A honing head for high-speed operation comprising a hollow holder having a plurality of guide slots angularly spaced from each other in the circumferential direction thereof, at least one cone shaft axially slidably mounted in said hollow holder and having at least one radially outward tapered portion extending axially thereof, and a plurality of honing stone supports radially movably disposed respectively in said guide slots, each of said honing stone supports having at least one radially inward cam surface held in contact with said tapered portion of said cone shaft, whereby said honing stone supports are radially movable in response to axial movement of said cone shaft, characterized in that each of said honing stone supports is connected to said cone shaft by at least one connector having one end connected to said honing stone support and the other end slidably received in a groove defined in said cone shaft, said groove being inclined in the same direction and at the same angle as said tapered portion of said cone shaft, said at least one cone shaft comprising a rough-finishing cone shaft and a finishing cone shaft which are independently axially movable in said hollow holder and have tapered portions, said honing stone supports comprising rough-finishing honing stone supports and finishing honing stone supports which are inserted alternately in said guide slots, said rough-finishing honing stone supports having cam surfaces held in contact with said tapered portions of said rough-finishing cone shaft, and said finishing honing stone supports having cam surfaces held in contact with said tapered portions of said finishing cone shaft.

2. A honing head according to claim 1, wherein one of said rough-finishing cone shaft and said finishing cone shaft has a cylindrical portion and a plurality of split branch members extending in parallel axially from said cylindrical portion and having said tapered portions held against said cam surfaces on one of said rough-finishing honing stone support and said finishing honing stone support, the other of said rough-finishing and finishing cone shafts including a rod portion and a plurality of radially outward projections mounted on said rod portion and having said tapered portions held against said cam surfaces on the other of said rough-finishing and finishing honing stone supports, said rod portion of said other cone shaft being inserted axially through said cylindrical portion of said one cone shaft with said projections fitted between said split branch members.

3. A honing head according to claim 2, wherein said plurality of split branch members and said plurality of projections have shoulders projecting from the axes of said cone shafts by the same distance, said shoulders being slidably engageable with the internal cylindrical surface of a hole in said holder receiving therein said rough-finishing and finishing cone shafts for allowing axial sliding movement of said cone shafts.

4. A honing head according to claim 2, wherein said cylindrical portion of said one cone shaft has a plurality of large-diameter portions which are slidably engageable with the internal cylindrical surface of a hole in said holder receiving therein said rough-finishing and finishing cone shafts for allowing axial sliding movement of said one cone shaft.

* * * * *